US005873509A

United States Patent [19]

Liao

[11] Patent Number: 5,873,509

[45] Date of Patent: Feb. 23, 1999

[54] MAGAZINE STRUCTURE FOR A POWER STAPLER

[76] Inventor: Walter Liao, No. 59, Sue Wang Road, Tali, Taichung Hsien, Taiwan

[21] Appl. No.: 62,322

[22] Filed: Apr. 20, 1998

[51] Int. Cl.[6] ..... B25C 5/06

[52] U.S. Cl. ..... 227/109; 227/119; 227/120

[58] Field of Search ..... 227/109, 119, 227/123, 120, 8

[56] References Cited

U.S. PATENT DOCUMENTS

| | | | |
|---|---|---|---|
| 3,720,364 | 3/1973 | Maestri | 227/109 |
| 3,834,602 | 9/1974 | Obergfell | 227/109 |
| 5,522,533 | 6/1996 | Mukoyama et al. | 227/109 |
| 5,632,431 | 5/1997 | Lin | 227/120 |
| 5,692,665 | 12/1997 | Lee | 227/119 |

*Primary Examiner*—Scott A. Smith
*Attorney, Agent, or Firm*—Bacon & Thomas, PLLC

[57] ABSTRACT

A magazine structure for a power stapler includes a magazine with a cover slidably connected thereto, an end board disposed to the magazine and having an elongate opening defined therethrough, a stopper board disposed to the end board and having a recessed portion and a slot defined in a bottom defining the recessed portion. A guide plate received in the slot and has two elongate apertures transversely defined therethrough, two pins respectively extending through the stopper board and the two elongate apertures so that a front side of the guide plate maintained to protrude in the recessed portion when an impact plate of the stapler actuating to the guide plate.

5 Claims, 5 Drawing Sheets

MAGAZINE STRUCTURE FOR A POWER STAPLER

BACKGROUND OF THE INVENTION

1. Field of the Invention

The present invention relates to a magazine structure of a power stapler and comprising a body for receiving nails and staples therein, and having an end board and a stopper board disposed to one of two ends thereof. The stopper board has recessed portion and a slot defined therein which pivotally receives a guide board therein which is biased by two springs and has two transverse holes with two pins extending therethrough so as to prevent inclined movement when ejecting a nail/staple in the recessed portion.

2. Brief Description of the Prior Art

FIG. 5 shows a conventional magazine structure for a power stapler and includes an elongate body 70 having a mediate plate 700 with a plurality of grooves 71 defined in both sides thereof, two flanges 72 extending laterally in opposite directions of a lower side of the mediate plate 700 and each of the flanges 72 having a slot defined therein. A cover 40 has a push member 42 slidably received therein and two rails 44 formed in a lower side thereof so as to be slidably received in the slots in the flanges 72. U-shaped staples 61 can be mounted onto the mediate plate 700 and are pushed by the push member 42, or T-shaped nails 60 can be disposed to a side of the mediate plate 70 with a head thereof received in the grooves 71 and also are pushed by the push member 42. An end board 80 is fixedly connected to an end of the body 70 and has an opening defined therethrough. A tongue member 83 extends from a periphery defining the opening so as to define an inverted U-shaped aperture 81 between the periphery defining the opening and the tongue member 83. The tongue member 83 has a plurality of grooves 71' defined in one of two sides thereof so that U-shaped staples 61 can be passed through the U-shaped aperture 81, or the head of the T-shaped nails 60 can be received in the grooves 71'. A stopper board 90 is disposed to the end board 80. The stopper board 90 has a recessed portion 96 defined therein and a slot 97 is defined in a bottom defining the recessed portion 96 in which a nail/staple to be impacted by an impact member 50 is received. A guide plate 98 is received in the slot 97 and has a top end with a hole 980 defined therethrough so that the guide plate 98 is pivotally received in the slot 97 by a pin 971 extending laterally through the stopper board 90 and the hole 980. The top end of the guide plate 98 has an inclined surface 981 defined laterally in a front side thereof. A spring plate 972 is pivotally received in the slot 97 and biases against a lower section of the guide plate 98 toward the recessed portion 96.

Referring to FIGS. 6 and 7, the guide plate 98 has its front side inclinedly protruding in the recessed portion 96 so that when a T-shaped nail 60 is pushed within the recessed portion 96, the nail 60 can be guided by a side of the guide plate 98. However, when the impact plate 50 is lowered to impact the nail 60 in the recessed portion 96, the guide plate 98 is pivoted about the pin 971 by an impact between the front side of the guide plate 98 and the impact member 50. The lower section of the guide plate 98 is pushed by the impact member 50 and pushed inwardly into the slot 97. The following nail 60 pushed by the push member 42 then could be inclined within the recessed portion 96 because the guide plate 98 is completely received in the slot 96. A jam of the nails 60 might happen if the inclination of the nail 60 in the recessed portion 96 is large. Furthermore, it requires a lot of machining processes when manufacturing the tongue member 83 which is a narrow and long member so that the tongue member 82 is therefore easily to be broken.

The present invention provides an improved magazine structure for a power stapler, which has a guide plate pivoted to the stopper board by two pines so as to mitigate the problems as mentioned above.

SUMMARY OF THE INVENTION

In one aspect of the present invention, there is provided a magazine structure for a power stapler and comprising a magazine having a plurality of first grooves defined in at least one of two sides thereof, a cover with a plurality of second grooves and slidably connected to the magazine, a push member slidably disposed to the cover.

An end board is fixedly connected to an end of the magazine and has an elongate opening defined therethrough, two groove portions respectively defined in two opposite sides defining the elongate opening.

A stopper board is fixedly connected to the end board and has a recessed portion defined in an inner side thereof which faces to the end board. The recessed portion is defined by a bottom thereof which has a slot defined therein and communicating with the recessed portion.

A guide plate is received in the slot with two second springs received in the slot so as to push a rear side of the guide plate toward the end board. The guide plate has two elongate apertures defined therein for two pins respectively to extend through the stopper board and the two elongate apertures. Each of the two elongate apertures has an axis which is perpendicular to an axis of the guide plate. The guide plate has an inclined surface defined in a front side thereof which protruding in the recessed portion.

It is an object of the present invention to provide a magazine structure having a guide plate which is impacted by an impact member and pushed into a slot of the stopper board without inclination.

It is another object of the present invention to provide a magazine structure having an end board with an elongate opening defined therethrough.

How these and other objects are accomplished will become apparent from the following descriptions and from the drawings.

DETAILED DESCRIPTION OF THE PREFERRED EMBODIMENT

Figure 1:
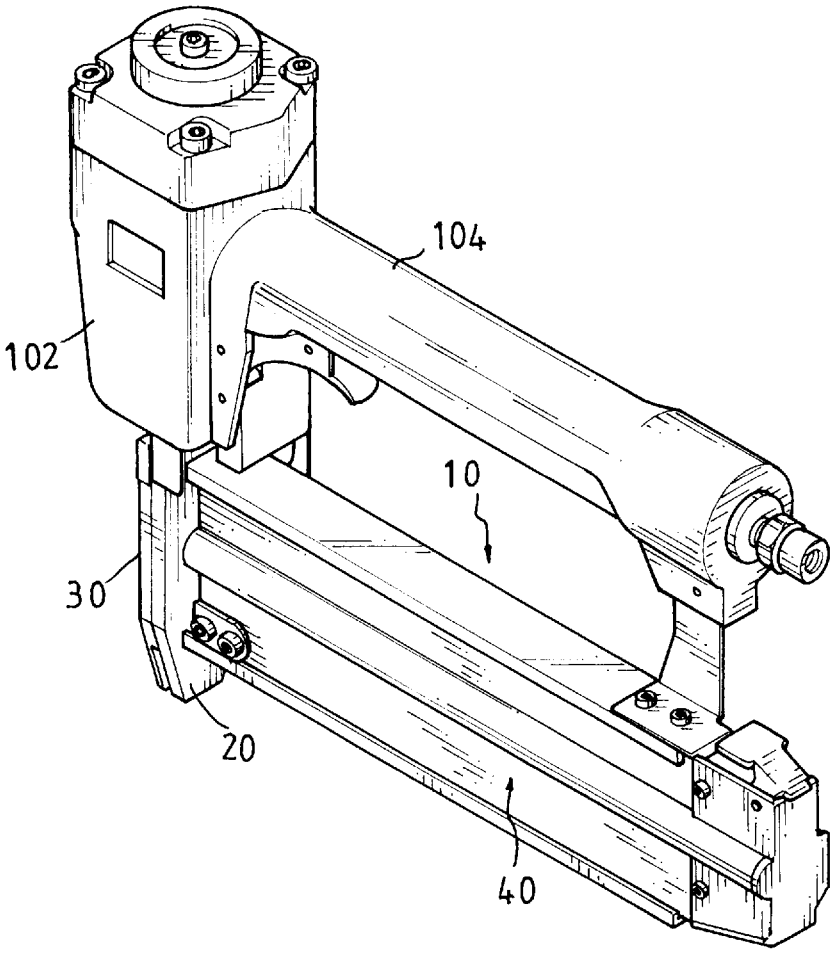
FIG. 1 is a perspective view of a power stapler with a magazine in accordance with the present invention.
Figure 2:
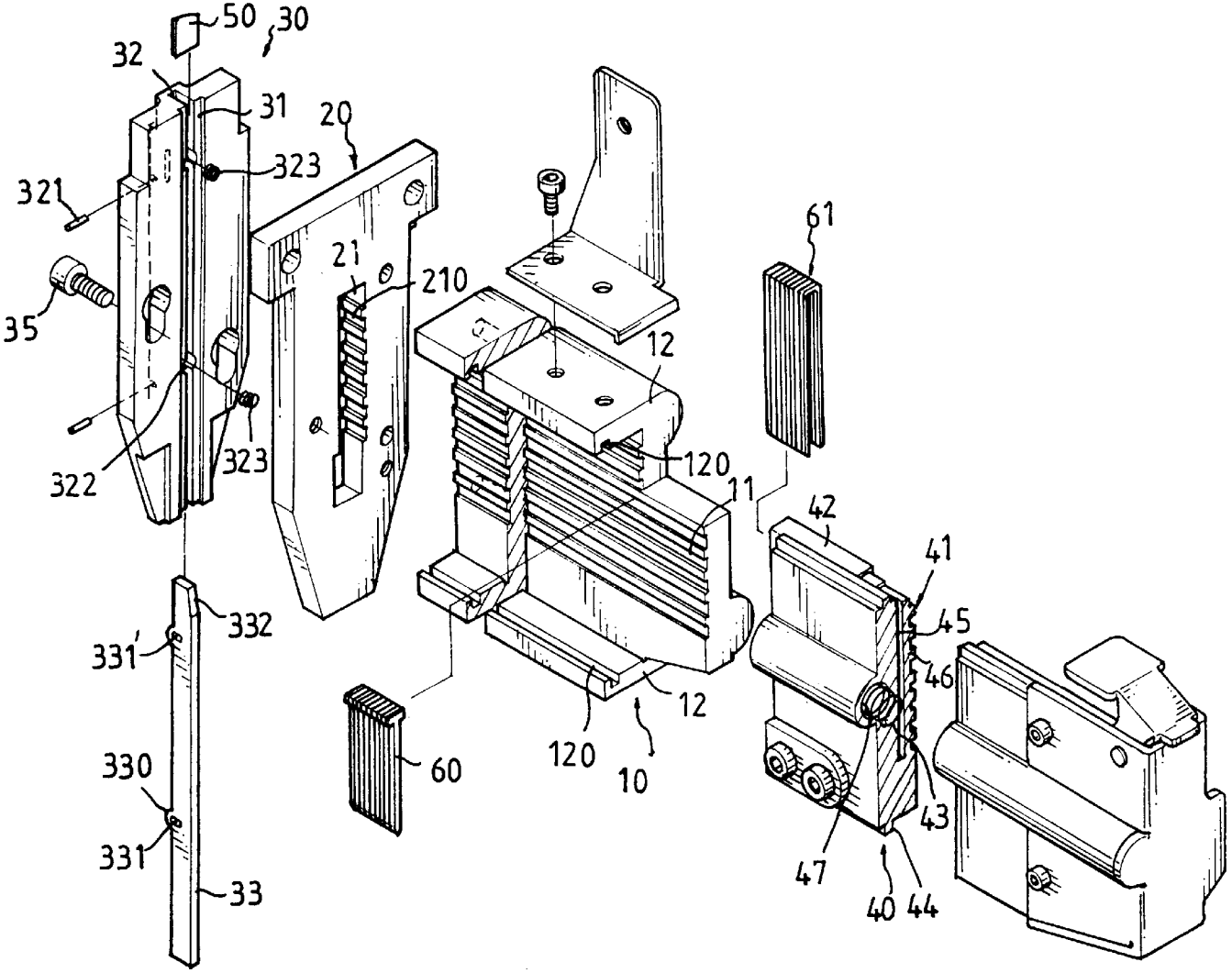
FIG. 2 is an exploded view of the magazine in accordance with the present invention.
Figure 4:
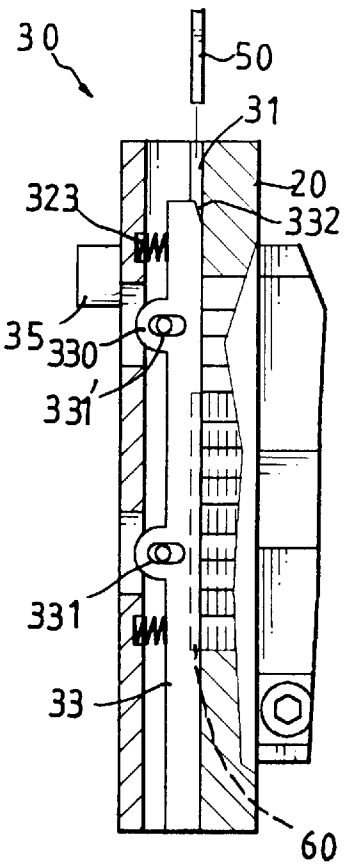
FIG. 4 is a side elevational view, partly in section, of the magazine to show a position of the guide plate when being impacted.
Figure 3:
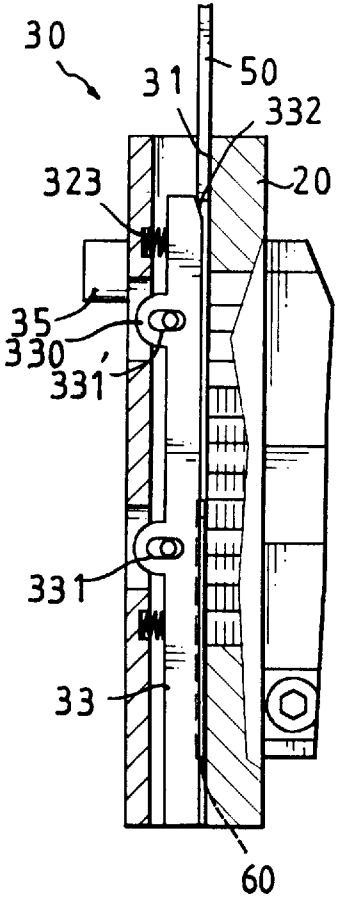
FIG. 3 is a side elevational view, partly in section, of the magazine to show a position of a guide plate when not being impacted.

Referring to the drawings and initially to FIGS. 1 through 3, a power stapler includes a main body 102 with a handle 104, a magazine 10 detachably connected to the main body 102 and an impact member 50 movably disposed to the main body 102. The impact member 50 is actuated by hydraulic force or electrical force.

The magazine structure in accordance with the present invention comprises a magazine 10 having a plurality of first grooves 11 defined in an inner side thereof. Two flanges 12 respectively extend from an upper side and a lower side of the magazine 10, each of the two flanges 12 having a slit 120 defined therein.

A cover 40 is slidably connected to the magazine 10 and has an elongate slit 45 defined longitudinally in the cover 40 and opening to an upper side thereof so as to form a saddle portion 46 which is separated from a body of the cover 40 by the elongate slit 45. The saddle portion 46 has a plurality of second grooves 41 defined in an inner side thereof which faces to the first grooves 11 of the magazine 10. The cover 40 has two rail members 44 extending from the upper side and a lower side thereof so as to be slidably received in the two slits 120 of the magazine 10. A push member 42 is slidably mounted to the saddle portion 46 and a first spring 43 is received in a passage 47 longitudinally in the cover 40, wherein the passage 47 communicates with the elongate slit 45 so as to push the push member 42.

An end board 20 is fixedly connected to an end of the magazine 10 and has an elongate opening 21 defined therethrough. Two groove portions 210 are respectively defined in two opposite sides defining the elongate opening 21.

A stopper board 30 is fixedly connected to the end board 20 by at least one bolt 35 and has a recessed portion 31 defined in an inner side thereof which faces to the end board 20. The recessed portion 31 is defined by a bottom thereof which has a slot 32 defined therein and communicating with the recessed portion 31. Two recesses 322 are respectively defined in two inner sides defining the slot 32 so as to receive two second springs 323 therein.

A guide plate 33 is received in the slot 32 and pushed by the two second springs 323 received in the slot 32 such that a rear side of the guide plate 33 is pushed by the two second springs 323 toward the end board 20. The guide plate 33 has two lugs 330 extending from the rear side thereof and each of the lugs 330 has an elongate aperture 331/331' defined therethrough. A longitudinal length of the lower elongate aperture 331 is longer than that of the upper aperture 331'. Two pins 321 respectively extend through the stopper board 30 and the two elongate apertures 331. Each of the two elongate apertures 331 has an axis which is perpendicular to an axis of the guide plate 33. The guide plate 33 has an inclined surface 332 defined in a front side thereof. The front side of the guide plate 33 inclinedly protrudes into the recessed portion 31 so that the T-shaped nails 60 are guided against a lateral surface of the guide plate 33.

U-shaped staples 61 are mounted to the saddle portion 46 and a lead staple 61 is received in the recessed portion 31 and is impacted by the impact member 50. T-shaped nails 60 are received between the first grooves 11 and the second grooves 45 with heads of the T-shaped nails 60 received in the first and the second grooves 11, 45. the lead nail 60 is guided by the lateral surface of the guide plate 33 and received in a partial area of the received portion 31. When ejecting the nails 60, the inclined surface 332 of the guide plate 33 allows the impact member 50 to easily extend into the recessed portion 31 and to eject the nail 60, wherein the impact member 50 has a groove (not shown) defined in a lateral surface thereof so as to maintain a minimum width of the front side of the guide plate 33 in the recessed portion 31. When the impact member 50 goes downwardly to a mediate portion of the guide plate 33 to contact the inclined front side of the guide plate 33, the guide plate 33 is pushed into the slot 32 till a position where the minim width of the front side of the guide plate 33 protrudes in the recessed portion 31 so as to properly guide the following nail 60. In other word, the lower section of the guide plate 33 is moved a longer distance than the upper section of the guide plate 33, this is the reason when the two elongate apertures 331, 331' has different longitudinal length.

Figure 5:
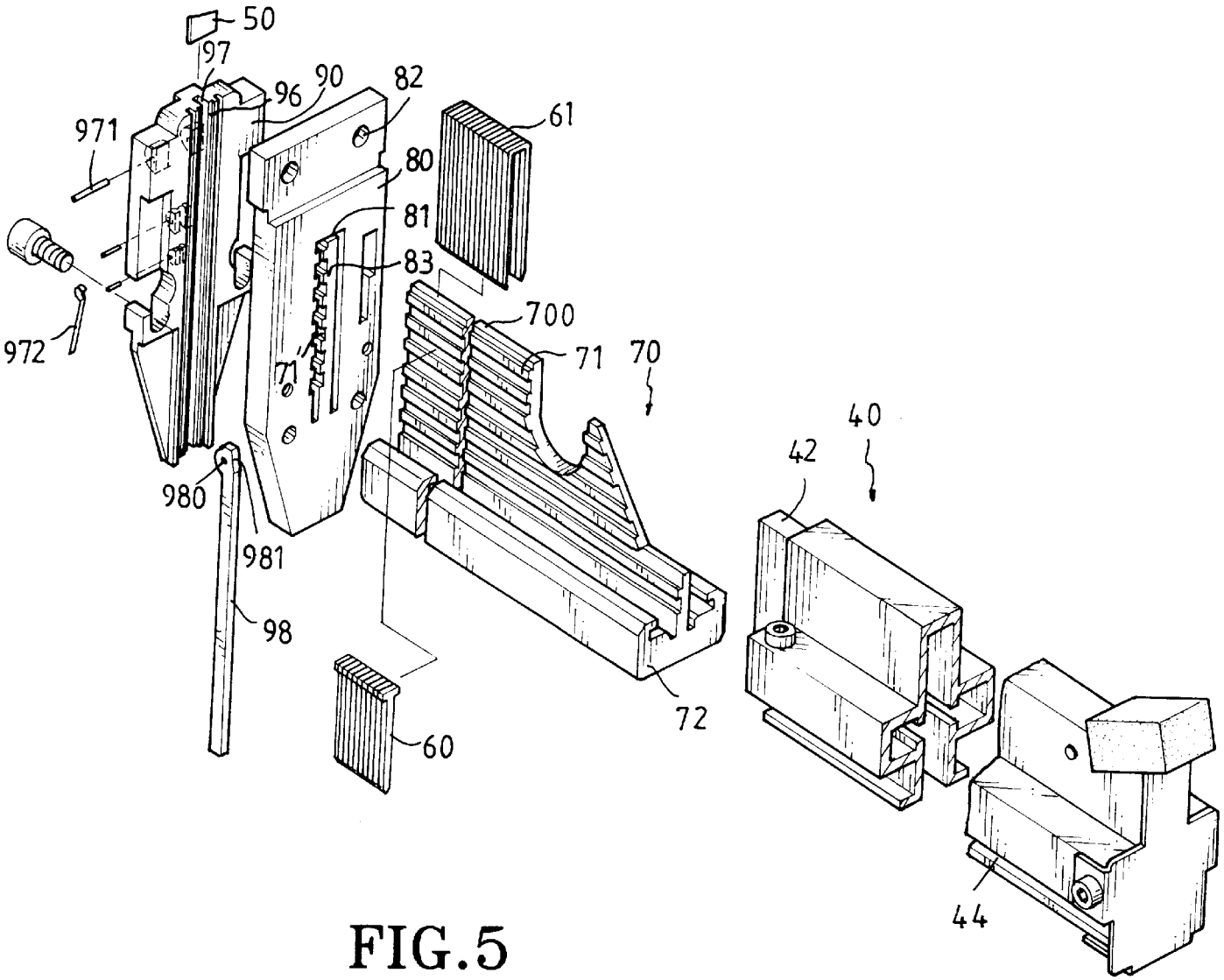
FIG. 5 PRIOR ART
FIG. 5 is an exploded view of a conventional magazine.
Figure 7:
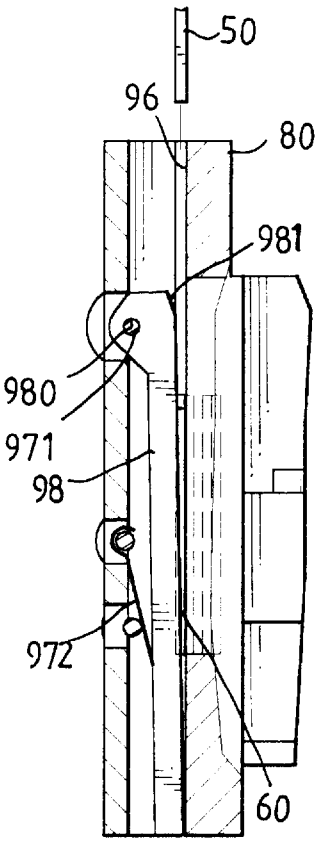
FIG.7 PRIOR ART
FIG. 7 is a side elevational view, partly in section, of the conventional magazine to show a position of the guide plate when being impacted.
Figure 6:
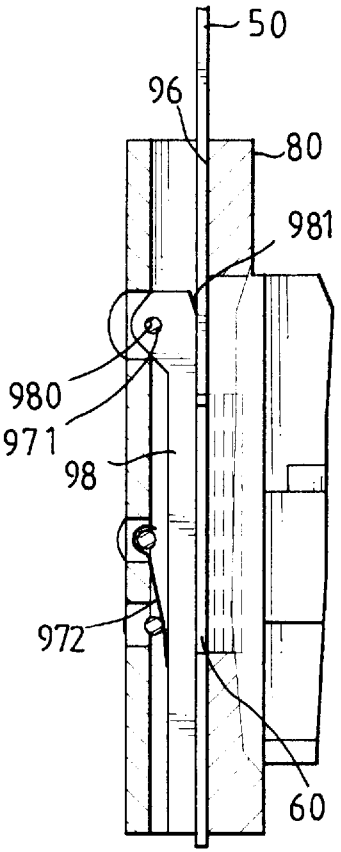
FIG.6 PRIOR ART
FIG. 6 is a side elevational view, partly in section, of the conventional magazine to show a position of a guide plate when not being impacted.

The end board 20 has no tongue member as the conventional one shown in FIG. 5 so that the manufacturing processes is simplified. The movement of the guide plate 33 effectively reduces jam possibility of the T-shaped nails 60.

While particular embodiments of the present invention have been illustrated and described herein, it is not intended to limit the invention and changes and modifications may be made therein within the scope of the invention as hereinafter claimed.

What is claimed is:

1. A magazine structure for a power stapler which includes a main body with a handle, a magazine detachably connected to said main body and an impact member movably disposed to said main body, the magazine structure comprising:

a magazine having a plurality of first grooves defined in at least one of two sides thereof;

a cover slidably connected to said magazine and having a push member slidably disposed thereto, said cover having a plurality of second grooves defined therein;

an end board fixedly connected to an end of said magazine and having an elongate opening defined therethrough, two groove portions respectively defined in two opposite sides defining said elongate opening;

a stopper board fixedly connected to said end board and having a recessed portion defined in an inner side thereof which faces to said end board, said recessed portion defined by a bottom thereof which has a slot defined therein and communicating with said recessed portion, and a guide plate received in said slot with two first springs received in said slot so as to push a rear side of said guide plate toward said end board, said guide plate having two elongate apertures defined therein and two pins respectively extending through said stopper board and said two elongate apertures, each of said two elongate apertures having an axis which is perpendicular to an axis of said guide plate, said guide plate having an inclined surface defined in a front side thereof and said front side of said guide plate protruding in said recessed portion.

2. The magazine structure as claimed in claim 1 wherein said cover has an elongate slit defined longitudinally therein and opening to an upper side of said cover so as to form a saddle portion which is separated from a body of said cover by said elongate slit defined therebetween, said saddle portion having said plurality of second grooves defined in an inner side thereof which faces to said first grooves of said magazine, said push member slidably mounted to said saddle portion and pushed by a second spring received in said cover.

3. The magazine structure as claimed in claim 1 further comprising two flanges respectively extending from an upper side and a lower side of said magazine, each of said two flanges having a slit defined therein, said cover having two rail members extending from an upper side and a lower side thereof so as to be slidably received in said two slits.

4. The magazine structure as claimed in claim 1 wherein said guide plate has two lugs extending from said rear side thereof and each of said lugs has said elongate aperture defined therethrough.

5. The magazine structure as claimed in claim 4 wherein one of said two elongate apertures is located higher than the other elongate aperture on said guide plate, a longitudinal length of said lower elongate aperture being longer than that of said higher elongate aperture.

* * * * *

UNITED STATES PATENT AND TRADEMARK OFFICE

CERTIFICATE OF CORRECTION

PATENT NO. : 5,973,509

DATED : October 26, 1999

INVENTOR(S): Hideki TANIGUCHI et al.

It is certified that an error appears in the above-identified patent and that said Letters Patent is hereby corrected as shown below:

On the title page, item [30] should be:

--[30] Foreign Application Priority Data

Jul. 12, 1995 [JP] Japan.....7-176084
Dec. 25, 1995 [JP] Japan.....7-337065--

Signed and Sealed this

First Day of May, 2001

*Attest:*

Nicholas P. Godici

NICHOLAS P. GODICI

*Attesting Officer*

*Acting Director of the United States Patent and Trademark Office*